US005579040A

United States Patent [19]

Sato et al.

[11] Patent Number: 5,579,040

[45] Date of Patent: Nov. 26, 1996

[54] VAPOR TYPE PRINTER APPARATUS USING A DETACHABLE CARTRIDGE

[75] Inventors: Shuji Sato, Kanagawa; Masanori Ogata, Saitama; Hiroyuki Shiota, Chiba, all of Japan

[73] Assignee: Sony Corporation, Tokyo, Japan

[21] Appl. No.: 288,390

[22] Filed: Aug. 10, 1994

[30] Foreign Application Priority Data

Aug. 11, 1993 [JP] Japan ..... 5-199610

[51] Int. Cl.[6] ..... B41J 2/175

[52] U.S. Cl. ..... 347/88; 347/83; 347/86

[58] Field of Search ..... 347/83, 87, 86, 347/88, 61, 66

[56] References Cited

U.S. PATENT DOCUMENTS 4,647,945 3/1987 Andeen et al. ..... 347/83

5,032,850 7/1991 Andeen et al. ..... 347/83

5,138,344 8/1992 Ujita ..... 347/86

*Primary Examiner*—Valerie A. Lund

*Attorney, Agent, or Firm*—Pasquale Musacchio, Esq.; Peter C. Toto, Esq; Jerry A. Miller

[57] ABSTRACT

A color video printer having a printer head portion and a cartridge detachable for supplying a solid dye to the printer head portion. The head portion vaporizes the solid dye and transfers the vaporized dye to a substrate. The cartridge is attached to the printer head portion when the supply of the dye is necessary. When the dye is supplied from the cartridge, the solid dye in the cartridge is liquefied and the liquefied dye is supplied to the printer head portion by capillarity.

36 Claims, 10 Drawing Sheets

VAPOR TYPE PRINTER APPARATUS USING A DETACHABLE CARTRIDGE

FIELD OF THE INVENTION

The present invention relates to a printer apparatus, and more particularly, to a vapor type color printer for making a thermal imprint of still color video or television images on paper using vapor type dyes, or the like.

BACKGROUND OF THE INVENTION

Vapor type printers have been proposed for applications requiring impression of video and/or television images on paper or the like. Such color video printers include a printer head which ultimately converts a solid dye into a vapor for printing on a substrate. Because this printer does not use an ink ribbon or a heat-sensitive head, it uses less electric power and is smaller in size.

In copending U.S. patent application Ser. No. 08/183836 which was filed on Jan. 21, 1994, a color video printer having a printer head capable of converting a solid dye and transferring into a substrate as a gas is disclosed. The above application is owned by the assignee of the present invention and is hereby incorporated herein by reference.

The color video printer head disclosed in U.S. patent application Ser. No. 08/183836 is explained with reference to FIGS. 12 and 13 as follows. FIG. 12 shows a perspective view of an example of the color video printer. FIG. 13 shows a cross-sectional view of a printer head assembly included in FIG. 12.

The color video printer 30A has an outer case 31A, a chassis 32A, a cassette 33A, a planar base 34A, a head assembly 35, a feed roller 36, a pressure driven roller 37, an electric source 38, a feed motor 39, a head driving circuit substrate 40 and a flexible wire harness 41.

The outer case 31A is a cubic box covering the whole of the color video printer 30A and has a discharge slot 31*a* on the right side thereof. The chassis 32A is an inside case for dividing the inside of the outer case 31A to a space for the cassette 33A and a space for other elements.

The cassette 33A holds a substrate 43 for printing such as a paper (referred to as "paper" hereinafter) and is provided in the left space of the chassis 32A. The right side of the cassette 33A is an opening. The paper 43 is pushed out from the opening one by one.

The planar base 34A is provided on the right space of the chassis 32A. The paper 43 is held between the planar base 34A and the head assembly 35.

The head assembly 35 is provided on the planar base 34A. The head assembly 35 is a printer head for printing to the paper 43 held between the planar base 34A and the head assembly 35. The head assembly 35 is pressed against the planar base 34A by springs 42*a* and 42*b* with a small load, about 50 g, for example.

The head assembly 35 has a solid dye tank 44 on the upper side thereof. The solid dye tank 44 includes a tank for solid powdered yellow dye 45Y, a tank for solid powdered magenta dye 45M and a tank for solid powdered cyan dye 45C (collectively referred to hereinafter as "powdered dye 45").

In the present invention, the powdered dye 45 may include any number of dye types including solidified disperse dye, liquefied disperse dye, sublimation disperse dye, or sublimation dye or disperse dye. In the preferred embodiment, the powdered dye 45 is defined as dye having a vapor pressure which is 0.01 pascal or more in a temperature range of 25° C. to a decomposition temperature. Further when dye molecules are associated with an average association value n in gas phase, the dye is defined as dye having a value equal to the vapor pressure of the dye divided by the average association value n, which is 0.01 pascal or more in a temperature range of 25° C. to a decomposition temperature. Solid dyes on the market corresponding with this definition is, for example, HSR-2031, ESC-155 or ESC-655.

The feed roller 36 and the pressure driven roller 37 are rotated in a reverse direction to each other by the feed motor 39. The paper 43 printed by the head assembly 35 is discharged outside from the discharge slot 31*a* being held by a small pressure of the feed roller 36 and the pressure driven roller 37.

The head driving circuit substrate 40 has a circuit for operating the head assembly 35. A terminal of the circuit is connected to the control circuit of the head assembly 35 through the flexible wire harness 41.

Referring to FIG. 13, the head assembly 35 has a solid dye tank 44 for accommodating powdered dye 45, a plurality of liquefied dye supplying passages 46 connected to the solid dye tank 44 and a vaporizer portion 47 connected to an exit of each liquefied dye supplying passage 46.

The liquefied dye supplying passage 46, the solid dye tank 44 and the vaporizer portion 47 are provided in a transparent plastic head base 49 through an insulating layer 48 formed by an insulating material such as polyamide.

A ventilator 44*a* is provided at an upper side of the solid dye tank 44 penetrating the insulating layer 48 and the head base 49. The diameter of the ventilator 44*a* is smaller than the diameter of the powdered dye 45. The ventilator 44*a* is used for sending out the powdered dye 45 to the liquefied dye supplying passage 46 smoothly.

The powdered dye 45 is introduced from the solid dye tank 44 to the liquefied dye supplying passage 46. The powdered dye 45 is liquefied and then is provided to the vaporized portion 47 by capillarity. The lower wall of the liquefied dye supplying passage 46 is made of a protecting layer 50 having a high durability.

A heater 51 made of an electric resistance element is provided at a lower surface of the insulating layer 48 which is the upper wall of the liquefied dye supplying passage 46. The heater 51 heats the powdered dye 45 up to the melting point so as to liquefy the powdered dye 45.

An entrance of the vaporizer portion 47 is joined with an exit of the liquefied dye supplying passage 46. A heating portion 52 heats the liquefied dye so that the liquefied dye is vaporized thereby. The heating portion 52 may include a laser source and a light-heat conversion layer.

A protection layer 50 is provided under the vaporizer portion 47 and beneath the heater 51.

A vapor hole 53 for getting out the vaporized dye is provided at the protection layer 50 located under the vaporizer portion 47.

Steps for printing by the color video printer 30A is explained as follows. At first, some pieces of paper 43 are put into the cassette 33A as shown in FIG. 12. A layer for accepting dye 43*a* is provided on the surface of the paper 43 as shown in FIG. 13. When a printing starts, the paper 43 is held between the head assembly 35 and the planar base 34A one by one by sufficient pressure to maintain contact between the head assembly 35 and the paper 43. At that time, the layer for accepting dye 43*a* faces the vapor pole 53.

On the other hand, the powdered dye 45 accommodated in the solid dye tank 44 is sent to the liquefied dye supplying passage 46 and heated to the melting point of the powdered dye 45 so that the powdered dye 45 becomes liquefied. The liquefied dye 45A runs inside of the liquefied dye supplying passage 46 by capillarity and is supplied to the vaporizer portion 47.

When the paper 43 is held between the feed roller 36 and the pressure driven roller 37, a print signal for a line of a color is sent to the circuit for operating the head assembly 35 from the head driving circuit substrate. The heating portion 52 of the head assembly 35 heats the liquefied dye 45A so as to vaporize the liquefied dye 45A accommodated in the portion 47.

The vaporized dye 47A goes through the vapor port 53 and is transferred to the layer for accepting dye 43*a* provided on the surface of the paper 43. The above-described printing steps are repeated three times for three colors (Y, M, C) so as to make one line of the color print.

The vaporized dye 47A transferred to the layer for accepting dye 43*a* is heated by the heat conducting through the protection layer 50 so that the vaporized dye 47A is fixed in the layer for accepting dye 43*a*.

SUMMARY OF THE INVENTION

One object of the present invention is to provide a printer having a small size and weight.

Another object of the present invention is to provide a printer head with improved storage properties.

According to a first embodiment of the present invention, a color video printer has a printer head portion and a cartridge for supplying a solid dye is attached to the printer head portion. The solid dye in the cartridge is liquefied and then supplied to the printer head portion as necessary. The printer head portion converts solid dye into a vapor and transfers it to a substrate. The cartridge is detachable from the printer head portion.

BRIEF DESCRIPTION OF THE DRAWINGS

FIG. 11 is another cross-sectional view of a liquefied dye supplying opening of.

DETAILED DESCRIPTION OF THE INVENTION

Figure 1:
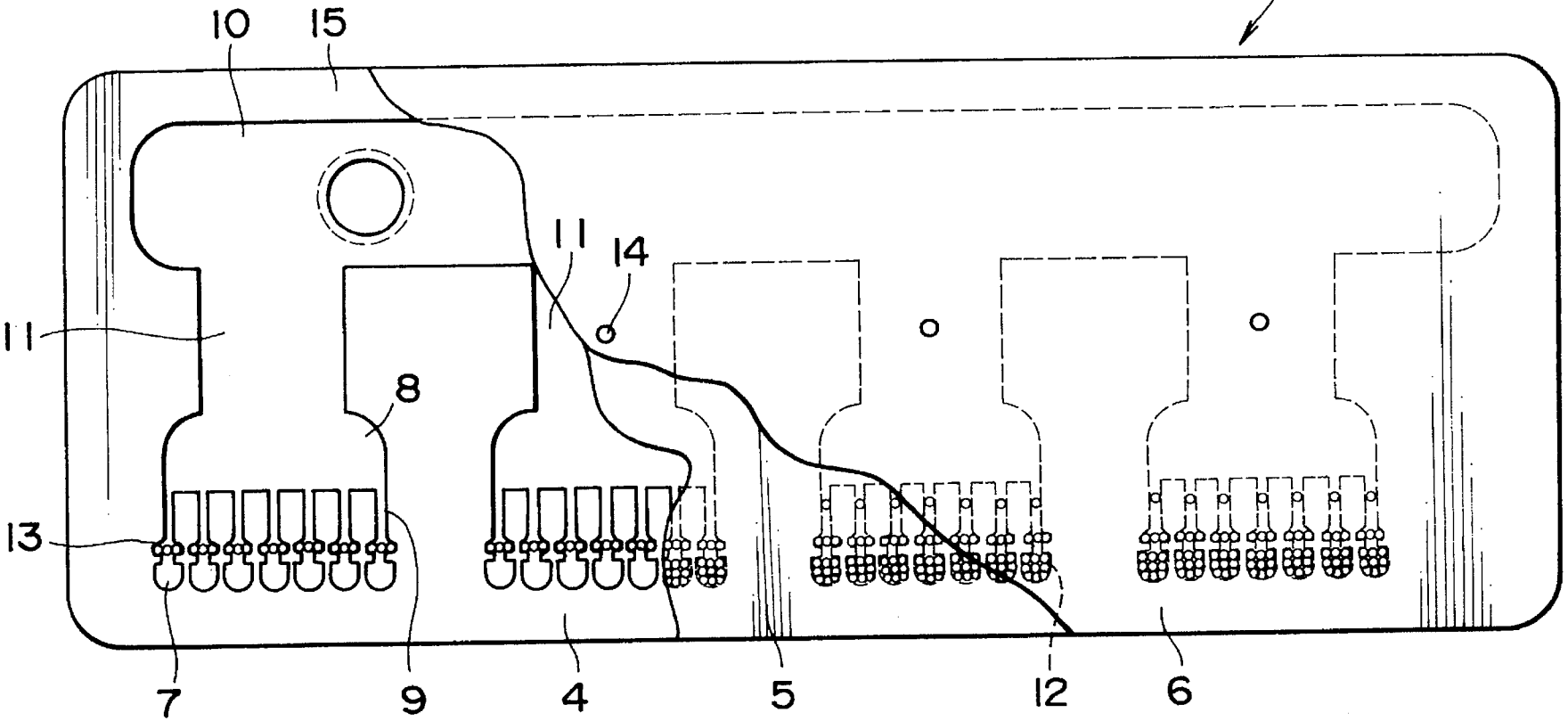
FIG. 1 is a view showing a liquefied dye supplying system of a printer head on a first example of the present invention.
Figure 2:
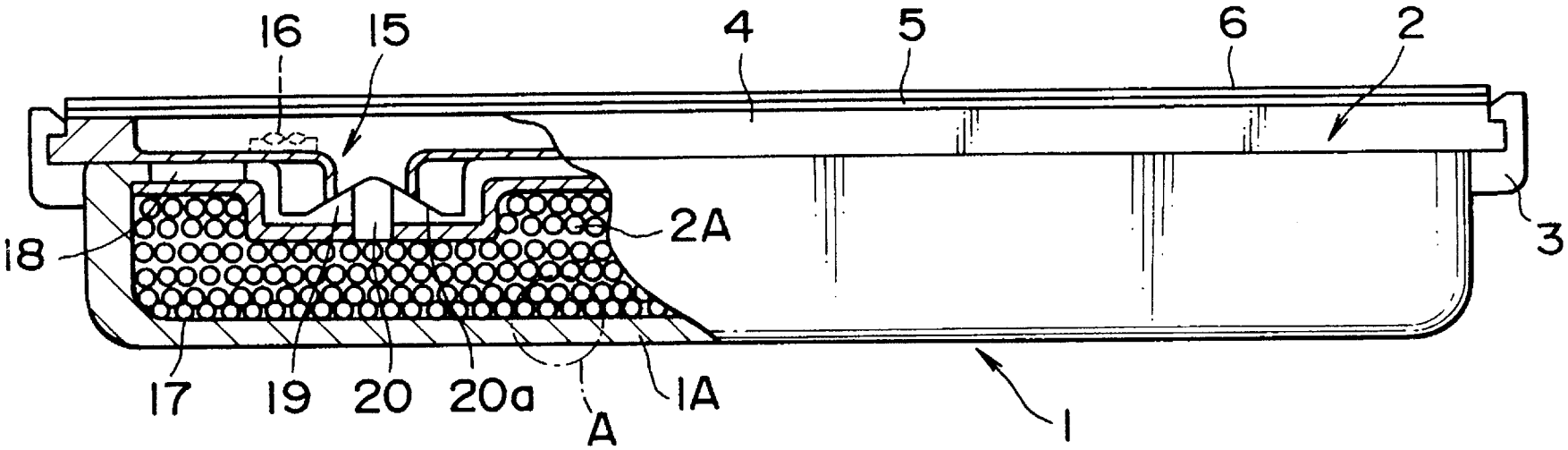
FIG. 2 is a view showing the printer head attached a cartridge of FIG. 1.
Figure 3:
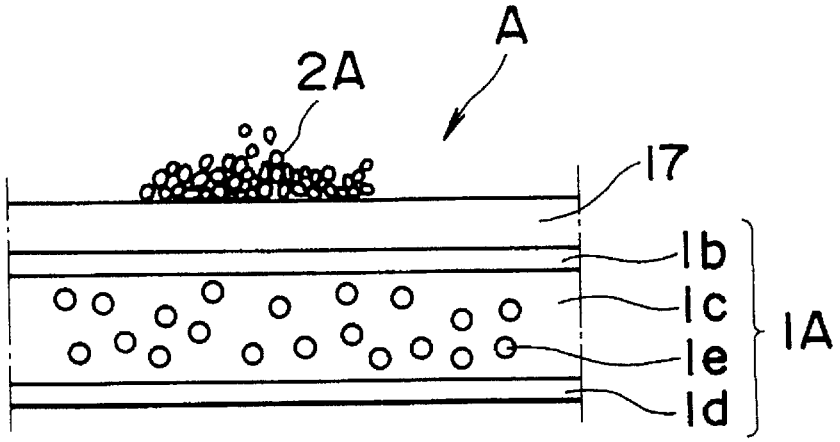
FIG. 3 is an enlarged view of a part of FIG. 2.
Figure 12:
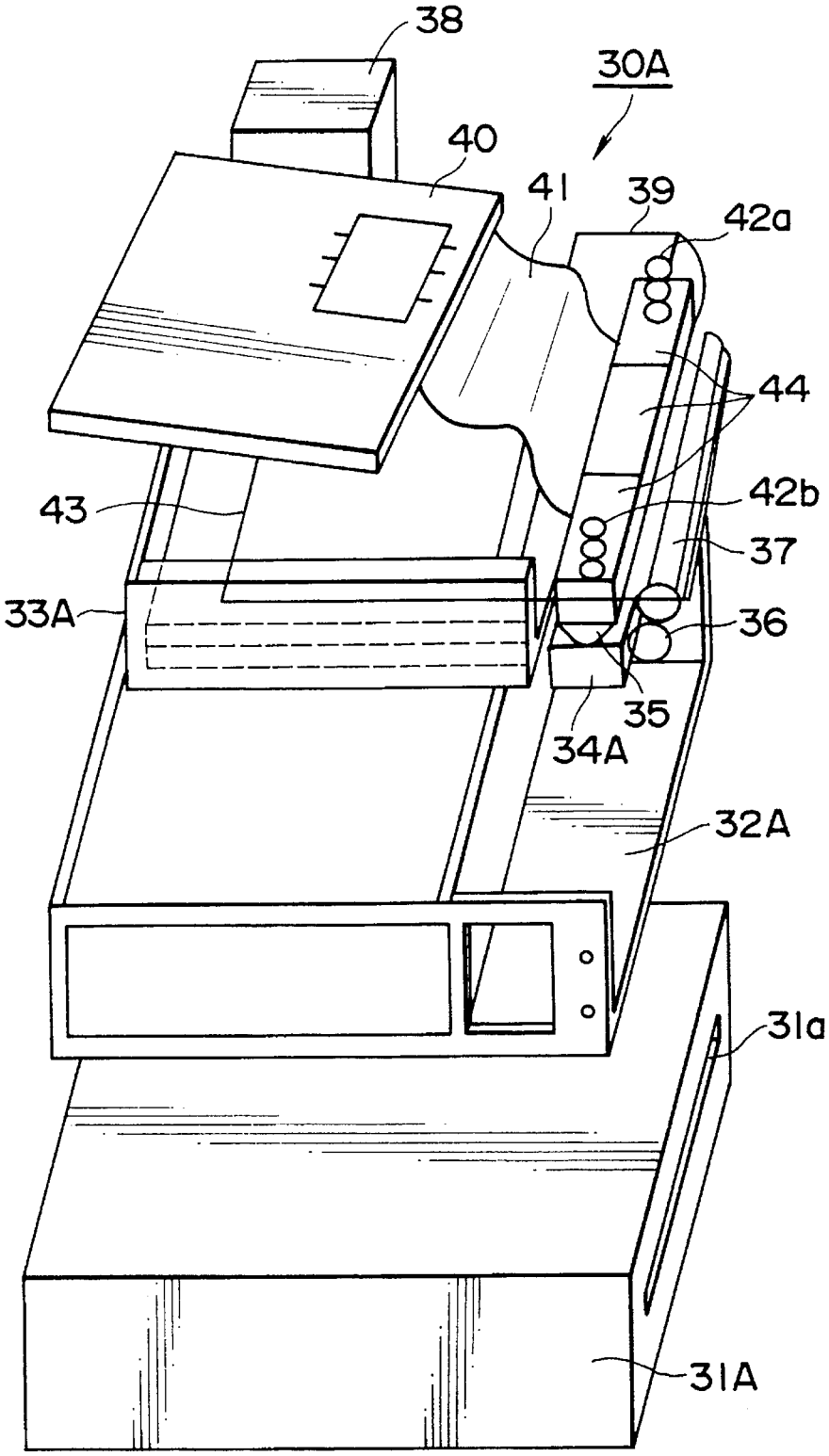
FIG. 12 is a perspective view of a color video printer.
Figure 13:
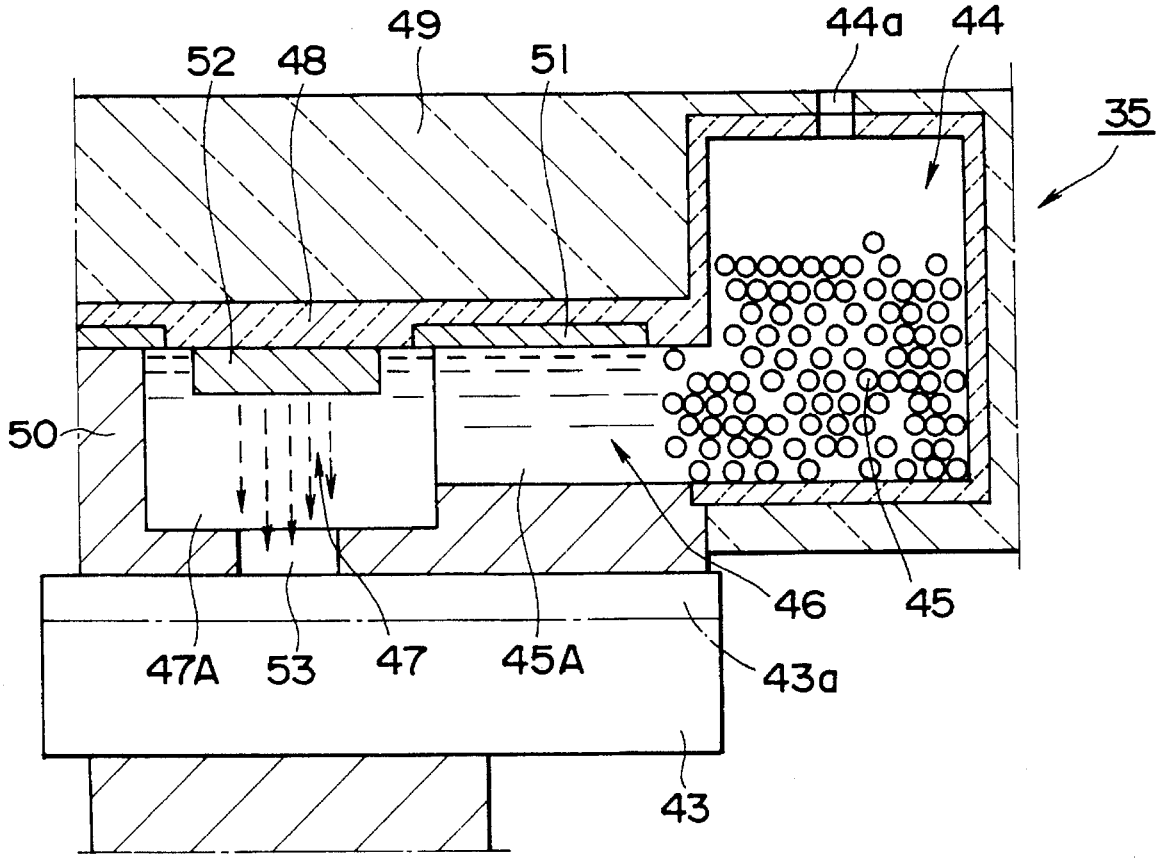
FIG. 13 is a cross-sectional view of a head assembly of a dye color video printer.

An example of a printer head of the present invention will be explained with reference to the figures as follows. A printer head of a first example of the present invention mainly has a head portion 2 and a cartridge 1 as shown in FIGS. 1, 2 and 3. The other parts are substantially similar to those of FIG. 12 and FIG. 13.

The cartridge 1 is removably attached to the head portion 2 by a hook 3 provided on the head portion 2.

The head portion 2 has a dye supplying system which has grooves provided on a head base 4 as shown in FIG. 1. A layer 5 is provided on the dye supplying system. The layer 5 is made of a material having reduced wetting and a good heat insulating properties. Further, a protecting layer 6 having a substantial ability to resist physical wear is provided on the layer 5 in order to protect the inside of the head assembly 2.

The dye supplying system has a plurality of dye transfer ports 7, a relay tank 8, a first liquefied dye supplying passage 9, a tank 10 and a second liquefied dye supplying passage 11 as shown in FIG. 1. There are a plurality of dye transfer ports 7 which form one printing line (there are 28 dye transfer ports 7 shown in FIG. 1). The dye transfer ports 7 are grouped together (the dye transfer ports 7 are divided into four groups in FIG. 1). A relay tank 8 is provided for each group of dye transfer ports. The relay tank 8 is connected to each dye transfer port 7 by each first liquefied dye supplying passage 9. The liquefied dye accommodated in the relay tank 8 is supplied to the dye transfer port 7 by capillarity of the first liquefied dye supplying passage 9. The tank 10 accommodates all liquefied dye for the head assembly 2. The second liquefied dye supplying passage 11 supplies the liquefied dye from the tank 10 to the relay tank 8 by capillarity.

Each dye transfer port 7 has a heating means. The heating means heats the liquefied dye supplied from the first liquefied dye supplying passage 9 so as to vaporize the liquefied dye. The vaporized dye comes out from a vapor hole 12 and is transferred onto paper.

A control portion 13 for controlling a supplying amount of the liquefied dye to the dye transfer port 7 is provided at the entrance of the dye transfer port 7. A liquefied dye holding material is filled in the control portion 13 so as to hold the liquefied dye at the time of heating. The liquefied dye holding material may be a pellet such as a glass bead.

The sectional area of the first liquefied dye supplying passage 9 is smaller than the sectional area of the second liquefied dye supplying passage 11. In other words, the sectional area becomes smaller getting closer to the dye transfer port 7 from the tank 10. The flow amount of the liquefied dye is set properly thereby.

A ventilator hole 14 is provided on the second liquefied dye supplying passage 11 so as to let air vent.

A dye supplying opening 15 is provided at an underside of a head base 4 so as to supply dye from the cartridge 1 to the tank 10.

A sensor 16 is provided in the head assembly 2 so as to detect an amount of the liquefied dye based on a temperature of the liquefied dye or an electric resistance of the liquefied dye and determine an amount of the liquefied dye supplied from the cartridge 1. An output signal of the sensor 16 controls a switching of a thin film heater 17 provided in the cartridge 1.

A heater (corresponding to a heater 51 of FIG. 13) is provided on a course of the liquefied dye from the tank 10 to the dye transfer port 7 and inside of the layer 5.

The cartridge 1 seals solid dye 2A. As shown in FIG. 3, an outside wall 1A has a double-structure holding an air layer so as to have good thermal insulation. This substantially reduces the amount of deterioration of the dye thus enabling the dye to be stored for a substantially longer period of time. The outside wall 1A has an inside wall layer 1*b* provided outside of a thin film heater 17, a thermal insulating layer 1*c* and an outside wall layer 1*d*. These layers are laminated. Air 1*e* is sealed in the thermal insulating layer 1*c* so as to improve a heat barrier effect.

The cartridge 1 has an opening portion 19 at a position corresponding to the dye supplying opening 15 of the head assembly 2. The opening portion 19 has a capillary tube 20 for sending the liquefied dye of the cartridge 1 to the dye supplying opening 15 and a head 20*a* connected to the dye supplying opening 15.

The cartridge 1 is attached to or detached from the head assembly 2 easily by operating the hook 3 by hand.

The cartridge 1 has the thin film heater 17 provided inside of the outside wall 1A and an electrode 18 connected to the thin film heater 17 for supplying an electric power to the thin film heater 17. The head assembly 2 also has an electric power and an electrode connected to the thin film heater 17 not shown in the figures.

When the cartridge 1 is attached to the head assembly 2, the electrode 18 is electrically connected to the head assembly 2 so as to supply an electric voltage from the head assembly 2 to the thin film heater 17. The solid dye 2A accommodated in the cartridge 1 is heated by the thin film heater 17 so as to liquefy the solid dye 2A.

A supply of an electric voltage to the electrode 18 is controlled by switching of the sensor 16. The supply of the electric voltage to the thin film heater 17 is controlled by an amount of the liquefied dye of the head assembly 2. As a result, only a predetermined amount of the solid dye 2A is heated and liquefied.

When the cartridge 1 is attached to the head assembly 2 by the hook 3, the head 20*a* is connected to the dye supplying opening 15 and the capillary tube 20 is connected to the liquefied dye supplying system of the head assembly 2 thereby. The solid dye 2A of a required amount is liquefied by the thin film heater 17 controlled by the sensor 16. The liquefied dye accommodated in the cartridge 1 goes through a plurality of capillary tubes 20 and is supplied to the head assembly 2.

Figure 5:
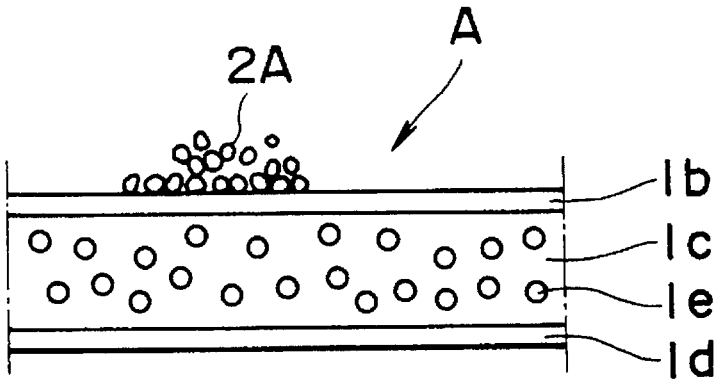
FIG. 5 is an enlarged view of a part of FIG. 4.
Figure 4:
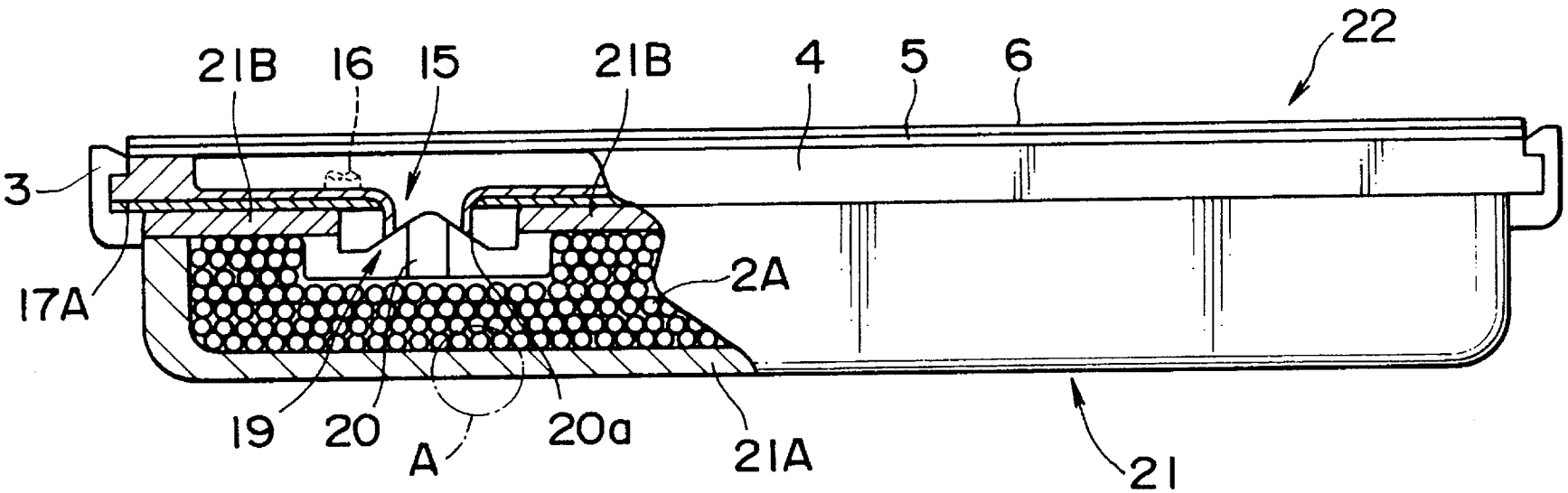
FIG. 4 is a view showing a second example of the printer head of the present invention attached to a cartridge.

A second example of a dye transfer type printer head of the present invention is shown in FIG. 4 and FIG. 5. The dye vapor type printer head has a cartridge 21, a head assembly 22 and a heater 17A in the head assembly 2.

The cartridge 21 accommodates a solid dye 2A which is sealed in a space formed by an outside wall 21A. A surface of the cartridge 21 contacting the head assembly 22 is made of a heat transfer board 21B.

The heat transfer board 21B is provided so as to confront the heater 17A. The heat transfer board 21B seals the solid dye 2A in the cartridge 1 and also transfers heat to the solid dye 2A.

The structures of the sensor 16 and the opening portion 19 of the second example are substantially similar to that of the first example.

The heater 17A is provided at a surface of the head assembly 22 attaching to the cartridge 21. The dye supplying opening 15 of the second example is the same as the first example.

Thus, at first the cartridge 21 is attached to the head assembly 22, and then is fixed to the head assembly 22 by the hook 3.

The heat transfer board 21B of the cartridge 21 confronts and contacts the heater 17A of the head assembly 22. Therefore, when the heater 17A is heated, heat is transferred to the solid dye 2A sealed in the cartridge 21 through the heat transfer board 21B.

The outside wall 21A has a hollow structure so as to preserve heat. Therefore the heat heating the solid dye 2A does not disperse outside easily.

The solid dye 2A of a predetermined amount is liquefied by controlling a heat amount properly. Further, because the heater 17 is provided in the head assembly 22, the size and/or the weight of the disposable cartridge 21 is reduced which also reduces the cost of the cartridge 21.

The sensor 16 for controlling an amount of the solid dye 2A which should be liquefied and the control means for controlling a heat amount of the second example are substantially similar to that of the first example.

Figure 6:
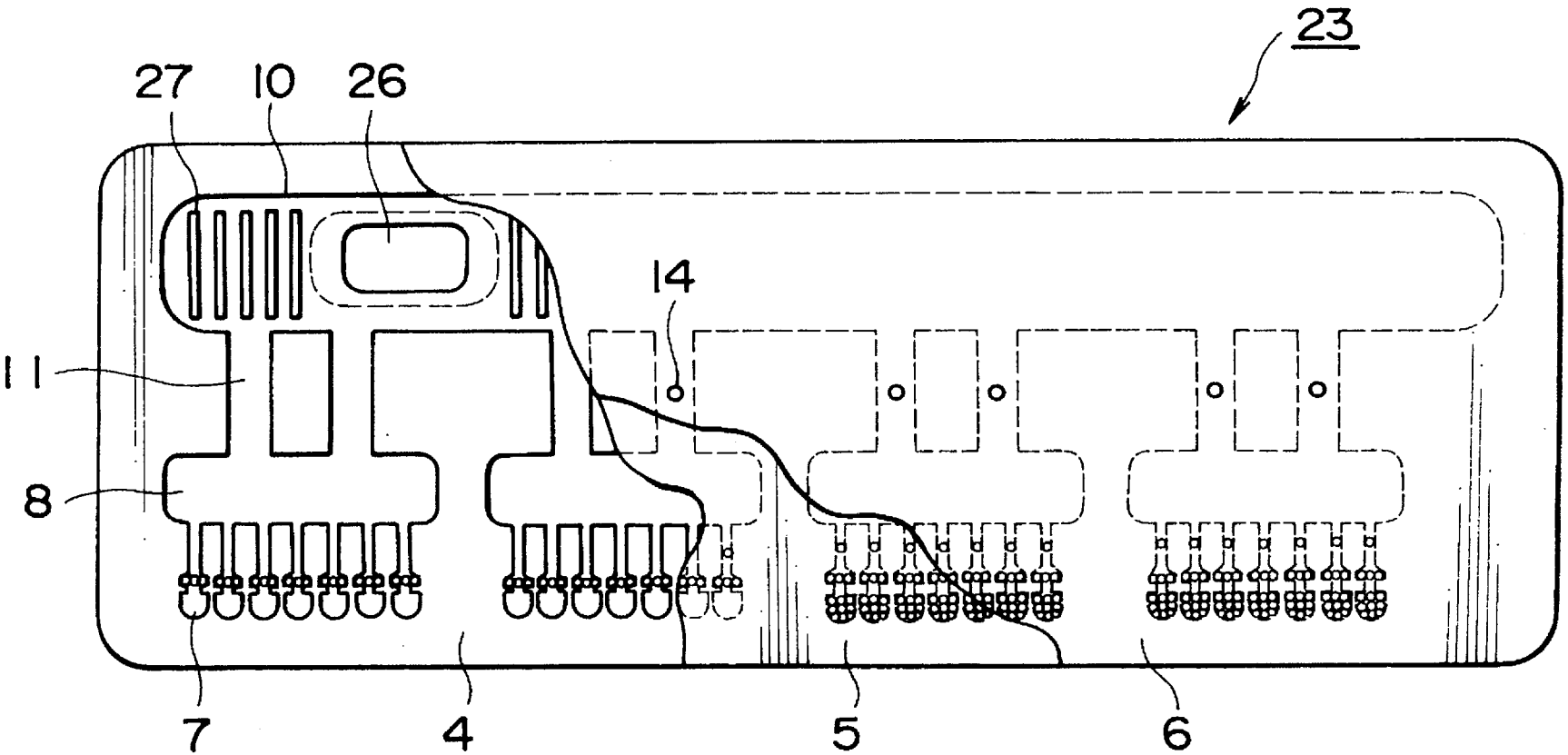
FIG. 6 is a view showing a third example of a liquefied dye supplying system for the printer head of the present invention.
Figure 7:
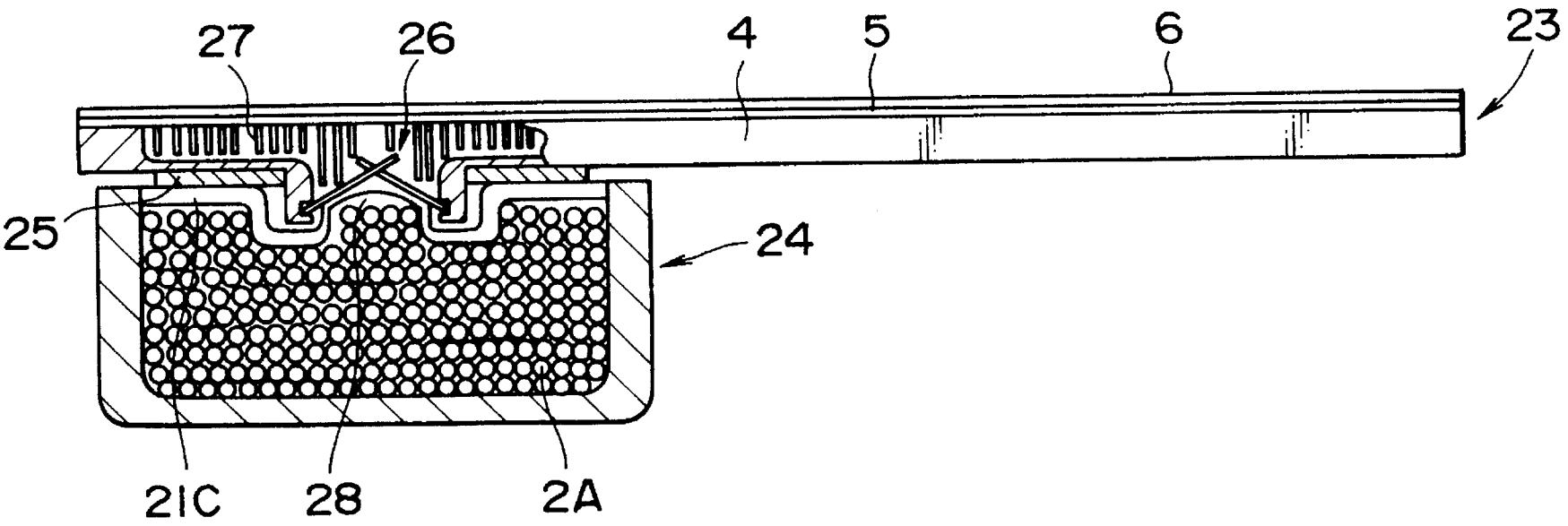
FIG. 7 is a view showing a printer head attached to a cartridge of FIG. 6.

A third example of a printer head according to the present invention is shown in FIG. 6 and FIG. 7. When all liquefied dye accommodated in the head assembly 23 is spent, a supply cartridge 24 is attached to the head assembly 23.

The liquefied dye supply system of the head assembly 23 of the third example is similar to the first example. The feature of the third example is as follows. A heater 25 is provided outside of the head base 4 of the head assembly 23. A dye supplying opening 26 has an automatic opening and closing structure. A plurality of capillary tubes 27 having a better wetting property in the liquefied dye than the supply cartridge 24 are provided in the tank 10 in order to increase a supply speed of the liquefied dye.

The supply cartridge 24 does not have a heater by itself as shown in FIG. 7. The supply cartridge 24 has a heat transfer board 21C which directly contacts the liquefied dye accommodated in the supply cartridge 24.

When the supply cartridge 24 is attached to the head assembly 23 with pressure, the heat transfer board 21C contacts the heater 25 provided on the head assembly 23. The heat transfer board 21C transfers heat of the heater 25 to the solid dye 2A accommodated in the supply cartridge 24. The solid dye 2A is liquefied by the heat.

The liquefied dye accommodated in the supply cartridge 24 goes through a dye supplying opening 26 which is opened by a convex shaped surface 28. The liquefied dye is then drawn up by a capillary tube 27 of the tank 10 at a high speed.

Figure 8:
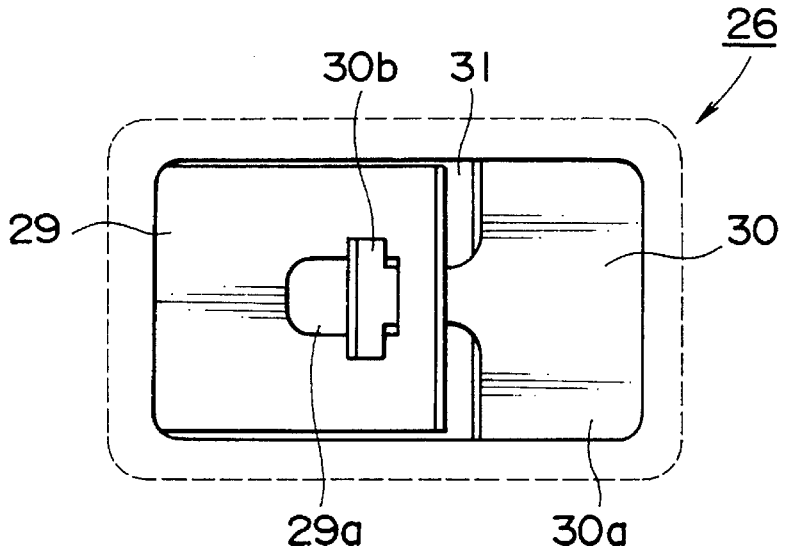
FIG. 8 is a plane view of a liquefied dye supplying opening.
Figure 9:
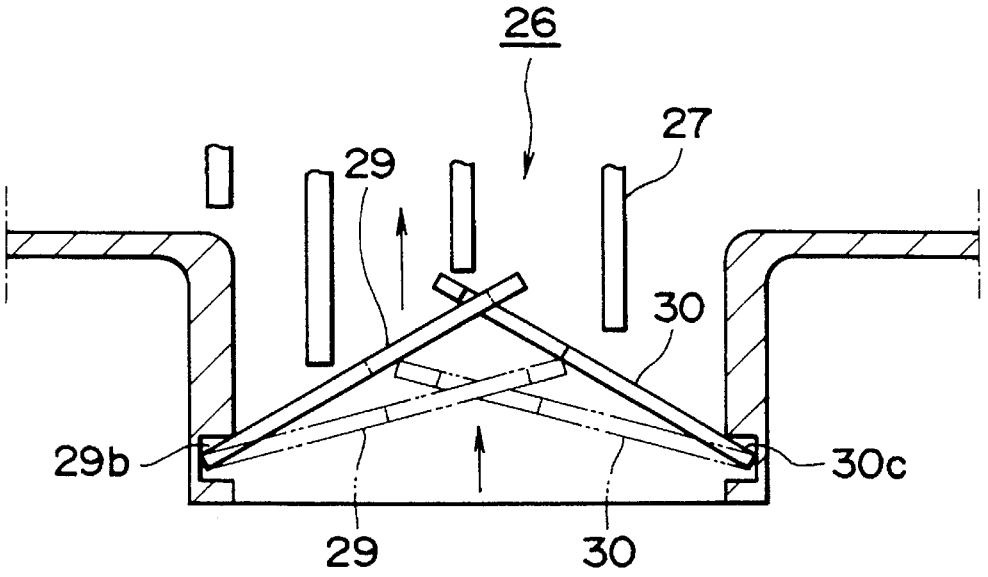
FIG. 9 is a cross-sectional view of a liquefied dye supplying opening.

The dye supplying opening 26 of the head assembly 23 is disclosed in FIG. 8 and FIG. 9. The dye supplying opening 26 is a double door structure which has a left door 29 and a right door 30. The left door 29 has a hole 29*a* which is a passage of a liquefied dye. The left door 29 rotates on a first support 29*b*.

The right door 30 has a rectangular body 30*a* and a T-shaped portion 30*b* which is unified with the rectangular body 30*a*. An upper portion of the T-shaped portion 30*b* is inserted into the hole 29*a* of the left door 29. The right door 30 rotates on a second support 30*c*.

When the supply cartridge 24 is detached from the head assembly 23, the left door 29 and the right door 30 are pushed to an lower side and are placed at a position shown by a dotted line of FIG. 9. At this position there is no gap between the left door 29 and the right door 30. Further the hole 29*a* of the left door 29 is closed by the T-shaped portion 30*b* of the right door 30. The dye supplying opening 26 is shut thereby.

When the supply cartridge 24 is attached to the head assembly 23, the convex surface 28 of the supply cartridge 24 pushes the dye supplying opening 26 and the left door 29 and the right door 30 move upward. The T-shaped portion 30*b* of the right door 30 moves in the hole 29*a* thereby. As a result, the hole 29*a* is open. At the same time, a gap 31 is made between the left door 29 and the right door 30.

The movement of the right door 30 is limited within a certain distance by a stopper formed by the hole 29*a* and the T-shaped portion 30*b*.

The liquefied dye is supplied from the supply cartridge 24 to the head assembly 23 through the hole 29*a* and the gap 31 by capillarity.

Figure 10:
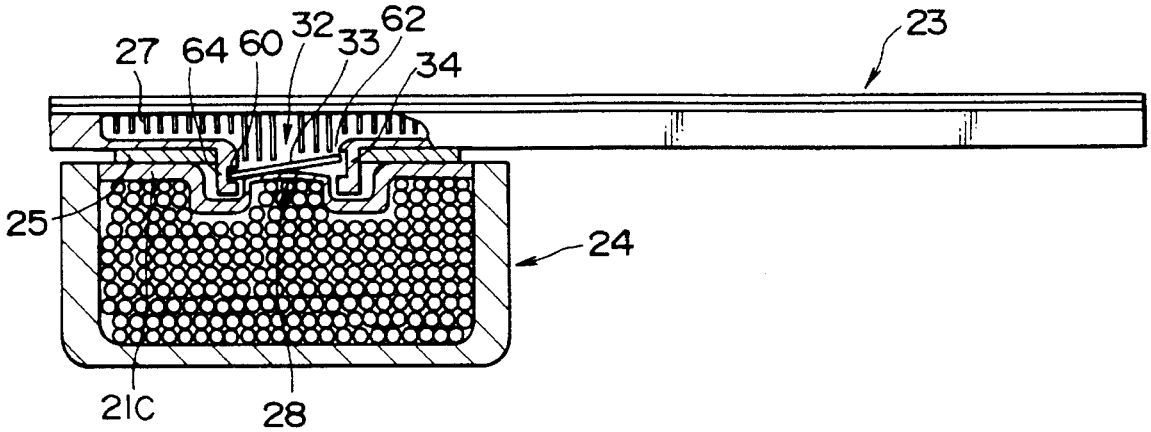
FIG. 10 is a view showing a printer head attached to a cartridge of a fourth example of the present invention.
Figure 11:
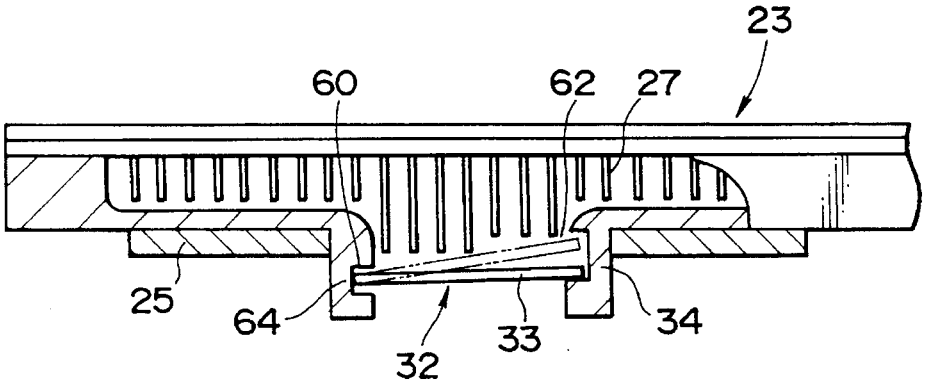

A fourth example of a dye vapor type printer head of the present invention is shown in FIG. 10 and FIG. 11. When all liquefied dye accommodated in the head assembly 23 is spent, a supply cartridge 24 is attached to the head assembly 23 similar to that of the third example.

The liquefied dye supplying system of the head assembly 23 of the fourth example is the same as the third example. However, the structure of a dye supplying opening 32 of the fourth example is different from the third example.

The dye supplying opening 32 has a planar board 33 having a first end 60 and a free end 62. The free end 62 is positioned within a first cutout portion 34 which limits movement of the free end 62 within a certain distance as shown in FIG. 10 and FIG. 11. The first end 60 is positioned within a second cutout portion 64 which is smaller than the first cutout portion 34. The second cutout portion 64 limits movement of the first end 60 within a distance less than that allowed by the first cutout portion 34 so as to enable the planar board 33 to rotate on first end 60. When the supply cartridge 24 is detached from the head assembly 23, the dye supplying opening 32 is closed.

The structure of the supply cartridge 24, except for the dye supplying opening 32, is substantially similar to that of the third example described above.

When the cartridge 24 is detached from the head assembly 23, the planar board 33 is kept downward. The dye supplying opening 32 is closed thereby.

When the convex surface 28 of the cartridge 24 pushes the dye supplying opening 32, the planar board 33 rotates on end 60. The free end 62 is then caused to move to the upper side of the first cutout portion 34 and the first end 60 is caused to move to the lower side of the second cutout portion 64. The dye supplying opening 32 becomes open thereby. The liquefied dye accommodated in the supply cartridge 24 goes through the dye supplying opening 32 pushed by the convex surface 28. Then the liquefied dye is drawn up by a capillary tube 27 of the tank 10 at a high speed.

The printer head of the present invention has the following effects.

A solid dye is sealed in a cartridge. The cartridge is attached to a head assembly when the printer is used. Further, a solid dye of a predetermined amount is liquefied which enables the size and weight of a head assembly to be reduced. Because a solid dye is sealed in the cartridge, the amount of time for which the dye is exposed to open air is substantially reduced.

Because a sensor for detecting an amount of a liquefied dye is provided in the head assembly, only a required amount of the solid dye is liquefied. This reduces the amount of energy that would be spent for liquefying additional amounts of solid dye.

Because a heater for liquefying the solid dye is provided in the head assembly, the cartridge does not need to have an electric power and a heater by itself. This simplifies the structure of the cartridge and reduces the size and weight of the cartridge.

When the cartridge is on the head assembly, a surface of the cartridge confronting the heater of the head assembly is a heat transfer board. As such, it is not necessary that the cartridge has a heating element such as a heater. This reduces the size and weight of the cartridge and reduces the cost of the cartridge.

A cartridge has a heater for liquefying a dye and a connecting means for supplying an electric power to the heater. An electric power is supplied from the power source of the head assembly to the heater through the connecting means. The cartridge does not need a power source in itself. This further simplifies the structure of the cartridge and reduces the size and weight of the cartridge.

The outside wall has a double structure holding a heat insulating material. This improves the heat barrier effect of the cartridge and further reduces the amount of energy required.

The head assembly has a display means for showing a finish of supplying a liquefied dye. It is easy to know the finish of supplying the liquefied dye. Just after finishing the supply of the liquefied dye, the cartridge is detached, thus reducing the weight of the head assembly.

The liquefied dye accommodating in the supply tank of the cartridge is supplied to the tank of the head assembly by a capillarity. A material of the supply tank of the cartridge has a reduced wetting property in the liquefied dye than a material of the tank of the head assembly so that the liquefied dye is supplied to the tank of the head assembly without a solvent. As such, an external force such as a pump, a gravity or a special structure for supplying the liquefied dye is not needed. The liquefied dye supplying opening of the head assembly has a double door which is open or closed automatically corresponding with attaching or detaching the cartridge. This eliminates a step for attaching or removing a cap when the liquefied dye is supplied to the head assembly.

While the present invention has been described in conjunction with specific embodiments, it is evident that many alternatives, modifications, permutations and variations will become apparent to those skilled in the art in light of the foregoing description. Accordingly, it is intended that the present invention embraces all such alternatives, modifications and variations as fall within the scope of the appended claims.

What is claimed is:

1. A printer comprising:

a printer head for storing a solid dye, transforming said solid dye to a vaporized dye and transferring said vaporized dye to a substrate;

a cartridge detachably attached to said printer head for storing a supply solid dye and refilling said printer head with said supply solid dye, said cartridge being detached from said printer head when said printer head is ready for printing; and a heater for liquefying said supply solid dye in said cartridge to produce a liquefied dye so that said liquefied dye is supplied from said cartridge to said printer head, wherein said printer head has a sensor for detecting an amount of said solid dye remaining in said printer head.

2. A printer comprising:

a printer head for storing a solid dye, transforming said solid dye to a vaporized dye and transferring said vaporized dye to a substrate, said printer head comprising:

a dye supplying hole;

a first tank connected to said dye supplying hole, for storing said solid dye;

a plurality of vaporizing portions; and a plurality of first dye supplying passages provided between said first tank and said vaporizing portions;

a cartridge detachably attached to said printer head for storing a supply solid dye and refilling said first tank with said supply solid dye, said cartridge having a dye supply portion to be connected to said dye supplying hole when said cartridge is attached to said printer head, and said cartridge being detached from said printer head when said printer head is ready for printing; and a heater for liquefying said supply solid dye in said cartridge to produce a liquefied dye so that said liquefied dye is supplied from said cartridge to said printer head.

3. The printer according to claim 2, wherein said cartridge has an outer wall having an inside layer, a heat insulating layer with air sealed therein and an outside layer.

4. The printer according to claim 2, wherein said cartridge has said heater.

5. The printer according to claim 4, wherein said printer head has a first electrode connected to a power supply and said cartridge has a second electrode connectable to said first electrode and connected to said heater so that a power is supplied from said printer head to said heater in said cartridge.

6. The printer according to claim 4, wherein said cartridge has a connecting portion for supplying an electric power to said heater.

7. The printer according to claim 4, wherein said printer head has a first electrode connected to a power supply and a sensor for detecting an amount of said solid dye remaining in said printer head and said cartridge has a second electrode connectable to said first electrode and connected to said heater so that a power is supplied from said printer head to said heater in said cartridge, a supply of said power to said heater being controlled according to said sensor.

8. The printer according to claim 2, wherein said dye supply portion comprises a capillary tube for supplying said liquefied dye in said cartridge to said dye supplying hole and an engaging part for connecting said capillary tube to said dye supplying hole.

9. The printer according to claim 2, wherein said printer head has a sensor for detecting an amount of said solid dye remaining in said printer head.

10. The printer according to claim 2, wherein said printer head has a display portion for indicating that a supply of said liquefied dye from said cartridge to said printer head is complete.

11. The printer according to claim 2, wherein said liquefied dye is supplied from said cartridge to said printer head by capillarity.

12. The printer according to claim 2, wherein a material of inside of said cartridge has wettability less than that of said first tank of said printer head.

13. The printer according to claim 2, wherein said dye supplying hole of said printer head has a double-door structure which is open when said cartridge is attached to said printer head and is closed when said cartridge is detached from said printer head.

14. A printer comprising:

a printer head for storing a solid dye, transforming said solid dye to a vaporized dye and transferring said vaporized dye to a substrate, said printer head comprising:

a dye supplying hole;

a first tank connected to said dye supplying hole, for storing said solid dye;

a plurality of groups of vaporizing portions, each of said groups having a plurality of said vaporizing portions;

a plurality of second tanks each provided to each of said groups of said vaporizing portions;

a plurality of first dye supplying passages provided between said first tank and said second tanks; and a plurality of second dye supplying passages provided between said second tanks and said vaporizing portions;

a cartridge detachably attached to said printer head for storing a supply solid dye and refilling said first tank with said supply solid dye, said cartridge having a dye supply portion to be connected to said dye supplying hole when said cartridge is attached to said printer head, and said cartridge being detached from said printer head when said printer head is ready for printing; and a heater for liquefying said supply solid dye in said cartridge to produce a liquefied dye so that said liquefied dye is supplied from said cartridge to said printer head.

15. The printer according to claim 14, wherein said cartridge has an outer wall having an inside layer, a heat insulating layer with air sealed therein and an outside layer.

16. The printer according to claim 14, wherein said printer head has dye holding portions between said second dye supplying passages and said vaporizing portions.

17. The printer according to claim 14, wherein said printer head has a ventilator for letting air vent.

18. The printer according to claim 14, wherein said printer head has a sensor for detecting an amount of said solid dye remaining in said printer head.

19. The printer according to claim 14, wherein said printer head has said heater therein.

20. The printer according to claim 14, wherein said cartridge has said heater.

21. The printer according to claim 20, wherein said printer head has a first electrode connected to a power supply and said cartridge has a second electrode connectable to said first electrode and connected to said heater so that a power is supplied from said printer head to said heater in said cartridge.

22. The printer according to claim 20, wherein said cartridge has a connecting portion for supplying an electric power to said heater.

23. The printer according to claim 20, wherein said printer head has a first electrode connected to a power supply and a sensor for detecting an amount of said solid dye remaining in said printer head and said cartridge has a second electrode connectable to said first electrode and connected to said heater so that a power is supplied from said printer head to said heater in said cartridge, a supply of said power to said heater being controlled according to said sensor.

24. The printer according to claim 14, wherein said dye supply portion comprises a capillary tube for supplying said liquefied dye in said cartridge to said dye supplying hole and an engaging part for connecting said capillary tube to said dye supplying hole.

25. The printer according to claim 14, wherein said printer head has a display portion for indicating that a supply of said liquefied dye from said cartridge to said printer head is sufficient.

26. The printer according to claim 14, wherein said liquefied dye is supplied from said cartridge to said printer head by capillarity.

27. The printer according to claim 14, wherein a material of inside of said cartridge has wettability less than that of said first tank of said printer head.

28. The printer according to claim 14, wherein said dye supplying hole of said printer head has a double-door structure which is open when said cartridge is attached to said printer head and is closed when said cartridge is detached from said printer head.

29. A printer comprising:

a printer head for storing a solid dye, transforming said solid dye to a vaporized dye and transferring said vaporized dye to a substrate; and a cartridge detachably attached to said printer head for storing a supply solid dye and refilling said printer head with said supply solid dye, said cartridge being detached from said printer head when said printer head is ready for printing; and a heater for liquefying said supply solid dye in said cartridge to produce a liquefied dye so that said liquefied dye is supplied from said cartridge to said printer head.

30. The printer according to claim 29, wherein said printer head has a first electrode connected to a power supply and said cartridge has said heater and a second electrode connectable to said first electrode and connected to said heater so that a power is supplied from said printer head to said heater in said cartridge.

31. The printer according to claim 29, wherein said cartridge has said heater and a connecting portion for supplying an electric power to said heater.

32. The printer according to claim 29, wherein said printer head has a first electrode connected to a power supply and a sensor for detecting an amount of said solid dye remaining in said printer head and said cartridge has said heater and a second electrode connectable to said first electrode and connected to said heater so that a power is supplied from said printer head to said heater in said cartridge, a supply of said power to said heater being controlled according to said sensor.

33. A printer comprising:

a printer head for storing a solid dye, transforming said solid dye to a vaporized dye and transferring said vaporized dye to a substrate;

a cartridge detachably attached to said printer head for storing a supply solid dye and refilling said printer head with said supply solid dye, said cartridge being detached from said printer head when said printer head is ready for printing; and a heater for liquefying said supply solid dye in said cartridge to produce a liquefied dye so that said liquefied dye is supplied from said cartridge to said printer head, wherein said printer head has a display portion for indicating that a supply of said liquefied dye from said cartridge to said printer head is sufficient.

34. A printer comprising:

a printer head for storing a solid dye, transforming said solid dye to a vaporized dye and transferring said vaporized dye to a substrate;

a cartridge detachably attached to said printer head for storing a supply solid dye and refilling said printer head with said supply solid dye, said cartridge being detached from said printer head when said printer head is ready for printing; and a heater for liquefying said supply solid dye in said cartridge to produce a liquefied dye, wherein said liquefied dye is supplied from said cartridge to said printer head by capillarity.

35. A printer comprising:

a printer head for storing a solid dye, transforming said solid dye to a vaporized dye and transferring said vaporized dye to a substrate;

a cartridge detachably attached to said printer head for storing a supply solid dye and refilling said printer head with said supply solid dye, said cartridge being detached from said printer head when said printer head is ready for printing; and a heater for liquefying said supply solid dye in said cartridge to produce a liquefied dye so that said liquefied dye is supplied from said cartridge to said printer head, wherein a material of inside of said cartridge has wettability less than that of inside material of said printer head.

36. A printer comprising:

a printer head for storing a solid dye, transforming said solid dye to a vaporized dye and transferring said vaporized dye to a substrate;

a cartridge detachably attached to said printer head for storing a supply solid dye and refilling said printer head with said supply solid dye, said cartridge being detached from said printer head when said printer head is ready for printing; and a heater for liquefying said supply solid dye in said cartridge to produce a liquefied dye so that said liquefied dye is supplied from said cartridge to said printer head, wherein said printer head has a dye supplying hole having a double-door structure which is open when said cartridge is attached to said printer head and is closed when said cartridge is detached from said printer head.

* * * * *